US008757063B2

(12) United States Patent
Alshinnawi et al.

(10) Patent No.: US 8,757,063 B2
(45) Date of Patent: Jun. 24, 2014

(54) PRINTING ON USED SHEETS OF PAPER

(75) Inventors: Shareef F. Alshinnawi, Durham, NC (US); Margaret M. Quinn, Cary, NC (US); Edward S. Suffern, Chapel Hill, NC (US); J. Mark Weber, Wake Forest, NC (US)

(73) Assignee: International Business Machines Corporation, Armonk, NY (US)

( * ) Notice: Subject to any disclaimer, the term of this patent is extended or adjusted under 35 U.S.C. 154(b) by 284 days.

(21) Appl. No.: 13/213,128

(22) Filed: Aug. 19, 2011

(65) Prior Publication Data

US 2013/0042778 A1 Feb. 21, 2013

(51) Int. Cl.
*B41F 33/00* (2006.01)

(52) U.S. Cl.
USPC ..... 101/483; 399/15; 399/391; 271/9.01

(58) Field of Classification Search
CPC ..... B65H 2301/544; B65H 2553/45
USPC ..... 399/388, 391, 15, 23, 399, 371; 101/483, 484; 271/9.01; 400/700
See application file for complete search history.

(56) References Cited

U.S. PATENT DOCUMENTS

| | | | | |
|---|---|---|---|---|
| 5,550,614 | A | 8/1996 | Motoyama | |
| 6,075,617 | A | 6/2000 | Fischer et al. | |
| 7,359,083 | B2 | 4/2008 | Salgado | |
| 7,782,508 | B2 | 8/2010 | Kondo | |
| 2009/0066987 | A1 | 3/2009 | Inokuchi | |
| 2009/0161129 | A1* | 6/2009 | Lek et al. | 358/1.9 |
| 2009/0190187 | A1 | 7/2009 | Cornell et al. | |
| 2011/0051181 | A1 | 3/2011 | Yoshimoto et al. | |
| 2011/0292453 | A1* | 12/2011 | Saluja | 358/3.28 |

FOREIGN PATENT DOCUMENTS

| | | | |
|---|---|---|---|
| JP | 2008238754 | A | 10/2008 |
| JP | 2010128334 | A | 6/2010 |

OTHER PUBLICATIONS

Bukkems et al., "A Piecewise Linear Approach Towards Sheet Control in a Printer Paper Path", Proceedings of the 2006 American Control Conference Minneapolis, Minnesota, USA, Jun. 14-16, 2006, pp. 1315-1320.

Saito Koji, "Abstract of JP2008238754(A)—Printer Device", publication date: Oct. 9, 2008, 1 page attached to foreign patent document JP2008238754(A), 12 pages.

Imaoka Kunio, "Abstract of JP2010128334(A)—Image Forming Apparatus", publication date: Jun. 10, 2010, 1 page attached to foreign patent document JP2010128334(A), 17 pages.

* cited by examiner

*Primary Examiner* — Matthew G Marini
(74) *Attorney, Agent, or Firm* — Katherine S. Brown; Jeffrey L. Streets

(57) ABSTRACT

A method of printing on a sheet of paper comprises drawing a first sheet of paper from a first paper source into a printer having an optical scanner and a print head, scanning a first face of the first sheet to determine the presence or absence of print thereon. In response to detecting print on the first face, the print head is caused to print an obstruction on the first face. In response to detecting no print on the first face, the print head is caused to print new matter on the first face. The method enables a printer to accept used paper while eliminating confusion over which face contains the new matter.

7 Claims, 3 Drawing Sheets

PRINTING ON USED SHEETS OF PAPER

BACKGROUND

1. Field of the Invention

The present invention relates to a method of printing on a used sheet of paper.

2. Background of the Related Art

Shared printers commonly have a high page-per-minute printing capacity and generally serve to minimize the cost per sheet of printing while serving a large number of users. A user may print a document such as an article, a set of drawings, a business plan or a computer program on sheets of paper that are automatically and sequentially fed from a paper feed bin into a shared printer. The user may pick up the printed document from a pick-up tray coupled to the shared printer.

A header sheet, also referred to as a user sheet, a title sheet and a banner sheet, is generally the first sheet of the printed document and enables users to quickly identify their document from others printed on a shared printer. The message or "header data" printed on a header sheet may conspicuously display a name or initials of the user, a user ID, a workstation number or other identifier of the user, workstation or work group that caused the document to be printed on the shared printer. The header sheet may also indicate, for example, the day and time that the document was printed and/or the total number of sheets in the printed document. The header data is commonly printed on a face of a new sheet of paper having two blank and unused faces. This new sheet of paper is retrieved by the printer from the same paper feed bin that is the source of the sheets of paper on which the document is printed.

Once the user has identified and retrieved their document from the printer, it is common for the user to immediately discard the header sheet because the identifying header data that is printed on face of the header sheet has no further utility. Even the document itself may eventually be discarded following use.

BRIEF SUMMARY

An embodiment of the method of the present invention comprises the steps of introducing a previously used sheet of paper into a printer having an integral optical scanner and at least one print head, scanning a face of the used sheet to determine the orientation of a used face bearing print, using a first print head to print an obstruction on the used face to obscure at least a portion of the print, printing new matter such as, for example, a header, on at least a portion of an available face opposite the used face to re-use the sheet, and then moving the re-used sheet to a pick-up tray.

Another embodiment of the present invention provides a computer program product including computer usable program code embodied on a computer usable storage medium, the computer program product comprising computer usable program code to optically scan a face of a sheet of paper to detect the presence or the absence of printed matter on the scanned face of the sheet, computer usable program code to determine the orientation of a used face and an opposite, available face of the sheet based on the detection of at least one of the presence and the absence of printed matter on the scanned face, respectively, computer usable program code to activate a first print head to print an obstruction on at least a portion of the printed matter on the used face, computer usable program code to activate a print head to print new matter, such as a header, on an available face opposite the used face, and computer usable program code to activate a sheet conveyor to move the sheet to a pick-up tray.

DETAILED DESCRIPTION

Figure 1:
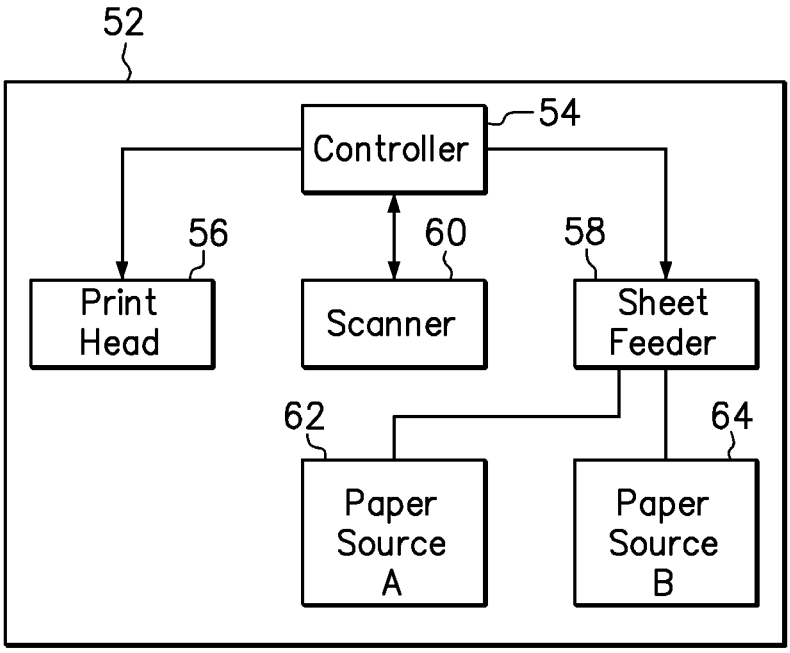
FIG. 1 is a schematic illustrating the interaction among components of a printer having an integral optical scanner that can be used to implement embodiments of the method of the present invention.

According to one embodiment of the present invention, a method is provided to print on a sheet of paper bearing previously applied print on a used face and having an opposite, available face to receive additional print. This method may be applied to print on, for example, a discarded header sheet bearing previously printed header data that has already served its purpose by providing, in a conspicuous manner, the identity of a user, a workstation or a user group that printed the document using a shared printer. Such header sheets may, in accordance with embodiments of the present invention, be deposited into a dedicated paper feed bin from which sheets may be retrieved and directed into a printer having an integral optical scanner to be printed on instead of being discarded as trash.

A sheet of paper, for example a previously printed header sheet bearing header data from a previous print job on a used face, may be received into a printer having an integral optical scanner and automatically positioned with a face of the sheet disposed adjacent to the optical scanner. The optical scanner may be used to scan the adjacent face of the sheet and detect if there is printed matter on the scanned face. Upon detecting printed matter on the scanned face, thereby making the scanned face a used face of the sheet, a print head may print an obstruction over the printed matter in order to obscure at least a portion of the used face. New matter, such as header data identifying, for example, a user, a workstation or a work group, may be printed on an available face of the sheet opposite the used face.

In one embodiment, the method may comprise receiving a sheet of previously used paper having a used face and an available face, into a printer having an integral optical scanner and positioning the sheet adjacent the optical scanner, scanning a first face of the sheet using the scanner, detecting the presence of print or the absence of print on the scanned face of the sheet, generating a signal from the optical scanner to a processor indicating the position or orientation of an available face corresponding to a scanned face having no detected printed matter thereon, and a used face corresponding to a scanned face having detected print thereon, using the processor to activate a print head to print an obstruction on the used face of the sheet, using a processor to activate at least one of the print head and a second print head to print new matter, such as header data, on the available face of the sheet, and moving the sheet to a pick-up tray adjacent one or more additional sheets comprising a document relating to, or identified by, the header data printed on the available face of the sheet.

Another embodiment of the invention comprises computer program product comprising computer readable program code for activating an optical scanner to scan a face of a sheet positioned adjacent the scanner and to thereby determine the orientation of a sheet having a face bearing previously printed matter and an opposite, available face for printing header data. The computer program product of this embodiment further comprises computer readable program code for activating a first print head to print an obstruction on the face of the sheet determined to have previously printed matter thereon to deter a user from subsequently reading the previously printed matter Computer readable program code is also provided for activating a sheet conveyor to invert and then return the sheet to position the opposite, available face adjacent the first print head, and for activating the first print head to print new matter, such as header data, on the available face disposed adjacent the first print head. Optionally, the computer program product may comprise computer readable program code for activating a scanner to determine the orientation of a sheet having an available face for printing new matter, such as header data, computer readable program code for activating a first print head to print an obstruction on the face of the sheet determined to have been previously printed matter thereon to deter a user from reading the used face, and computer readable program code for activating a second print head disposed opposite a sheet pathway to print a new header on the available face.

Importantly, embodiments of the present invention obviate the need for the user to orient the previously used sheet prior to depositing the sheet into a paper feed bin or prior to feeding the sheet into a printer having an integral optical scanner. Users are generally too busy to take the time to ensure that the previously used sheet is placed into a paper feed bin or into a printer with the used side (bearing previously printed matter) directed in a prescribed orientation. It would be advantageous if previously used sheets of paper having a remaining available face could be reprocessed without requiring users to take the time to carefully orient the sheets into a paper feed bin. This important benefit is provided by enabling the use of a printer having an integral optical scanner to determine if a scanned face of the sheet bears print, and the use of a processor to activate a print head to print an obstruction on a face of the sheet bearing print to at least partially obscure the print. This prevents a user from being confused or distracted by the previously printed matter, which no longer bears useful information or data. The method further enables the processor to activate a print head, which may be the same print head used to print the obstruction, to print new matter, such as header data, on an available face of the sheet disposed opposite the used face.

Embodiments of the present invention may be implemented using, for example, but not by way of limitation, a charge-coupled device, a contact image sensor or a photomultiplier tube as the image sensor. Alternately, a digital camera scanner or a planetary scanner may be used as the image sensor. It should be understood that one or more of these devices could be used to optically recognize characters and/or to create an electronic image of print that may be present on a scanned face but, as described herein above, the amount of processing capacity needed to execute embodiments of the present invention may be minimized by using the optical scanner of the printer to generate and send a signal merely indicating the presence or absence of print on a scanned face of the sheet (as opposed to, for example, generating a signal providing an electronic image of recognizable characters that might make up the printed matter on a scanned face of a sheet).

In some embodiments of the present invention, the optical scanner of the printer may be adjustable so that a larger or smaller amount of print may be required in order to generate a signal indicating the presence of printed matter on a scanned face of the sheet. In these embodiments, adjustments may be made to prevent "false positives," that is, to prevent an obstruction from being printed on a scanned face as the result of very limited amount of print (for example, bearing only one or two characters) being detected on the scanned face or from the detection of print on the opposite face of the sheet being detected through the sheet due to optical "bleed through" to an optical scanner of the printer that is disposed adjacent to the opposite, available face of the previously used sheet.

Embodiments of the present invention may be implemented using a printer having an integral optical scanner and having one or more sheet conveyors, that is, one or more devices comprising actuated drive rollers, deployable sheet pathway diverter members and/or air-assisted sheet displacers (using either vacuum or positive pressure, or both) to manipulate sheets of paper from and/or to paper pathways formed by or between these devices. Such sheet conveyors may, alternately or in combination with other devices, comprise movable conveyor belts that frictionally engage and move sheets of paper along a sheet pathway within the device. Such devices may be used, for example, but not by way of limitation, to retrieve sheets from a paper source, such as a paper supply bin, to move sheets from a paper supply bin to a position adjacent an optical scanner within a printer, to move sheets from a position adjacent an optical scanner to a position adjacent a print head of the printer, to move sheets from a position adjacent a print head to a position adjacent a second print head of the printer, or to move sheets from a position adjacent an optical scanner or adjacent a print head and through a sheet pathway that returns the sheet, in an inverted orientation, to the position adjacent the optical scanner or adjacent the print head of the printer. The latter action using a sheet conveyor may be used, for example, to enable a print head to print an obstruction to obscure at least a portion of printed matter detected on a scanned face of a sheet and then to move, invert and return the sheet to the same position adjacent the print head to print a header on an available face of the sheet opposite the face on which the obstruction was printed by the print head. Alternately, a sheet conveyor may be used to enable a print head to print new matter, such as header data, on an available face of the sheet where no print is detected by an optical scanner and then to move, invert and return the sheet to the same position adjacent the print head to print an obstruction to obscure print on a used face of the sheet opposite the face on which the header was printed by the print head. It will be understood that the same approach may be used to scan a first face of a sheet and to then scan the opposite face of the sheet using the same optical scanner.

FIG. 1 is a schematic illustrating the interaction among components of a printer 52 that can be used to implement embodiments of the method of the present invention and shows a controller 54 capable of sending signals to a print head 56 and to a sheet feeder 58. It should be understood that printers having two or more print head may also be used to implement some embodiments of the present invention. FIG. 1 further shows that the controller 54 is capable of activating an integral optical scanner 60 to scan a sheet of paper positioned adjacent the scanner 60 and also of receiving a signal from the integral optical scanner 60 indicating, for example, the orientation of a sheet of paper having a used face and an available face.

The sheet feeder 58 of FIG. 1 is shown as being capable of retrieving sheets of paper from either of two paper sources, Paper Source A 62 and Paper Source B 64. For example, but not by way of limitation, Paper Source A 62 may be used to provide clean sheets, having no print on any face thereon, and Paper Source B 64 may be used to provide previously used sheets having print on a used face and having an available face opposite the used face.

Figure 2:
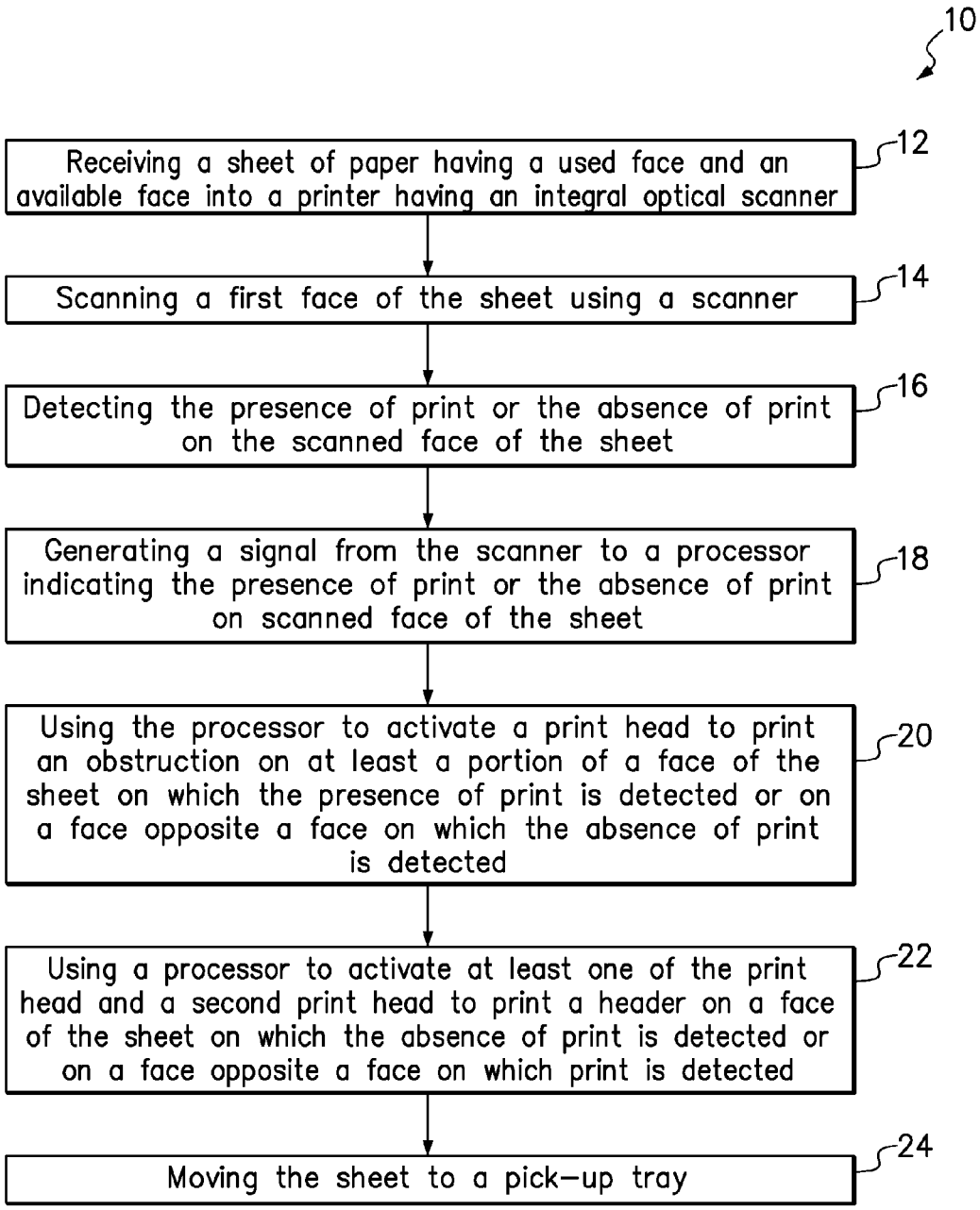
FIG. 2 is a flow chart illustrating the steps of one embodiment of the method of the present invention.

FIG. 2 is a flow diagram illustrating the steps of one embodiment of a method 10 of printing on a previously used sheet of paper. In step 12, a sheet of paper having a used face bearing print thereon and an opposite, available face is received into a printer having an integral optical scanner. In step 14, a first face of the sheet is scanned using the scanner. In step 16, the presence of print or the absence of print is detected on the scanned face of the sheet. In step 18, a signal from the scanner to a processor is generated to indicate the presence of print or the absence of print on the scanned face of the sheet. In step 20, the processor is used to activate a print head to print an obstruction on at least a portion of a face of the sheet on which the presence of print is detected or on the face opposite a face on which print is detected. In step 22, the processor is used to activate at least one of a second print head and the first print head to print a header on the face of the sheet on which the absence of print is detected or on a face opposite a face on which print is detected and, in step 24, the sheet bearing the header is moved to a pick-up tray for retrieval by the user that caused the header to be printed.

Figure 3:
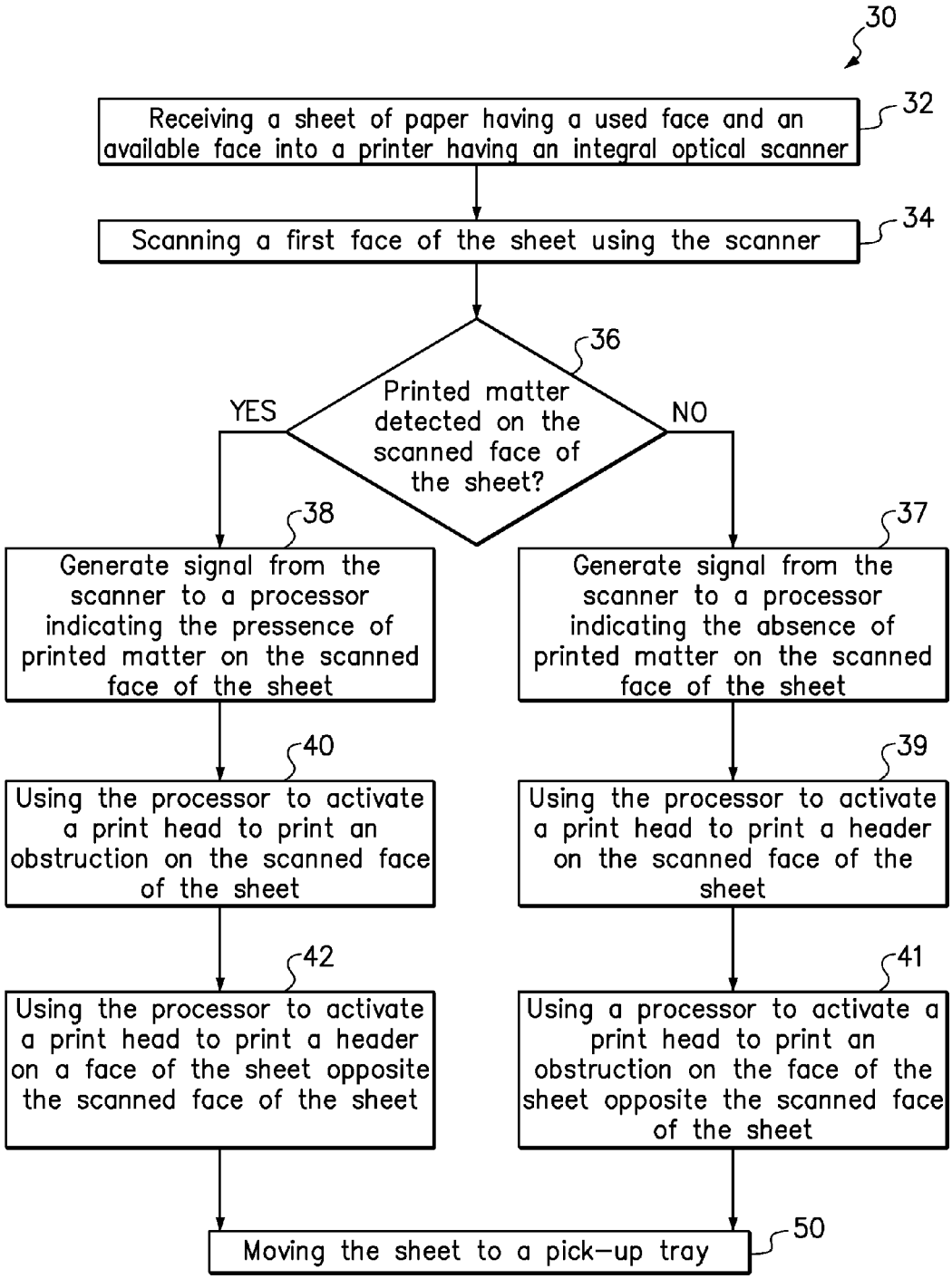
FIG. 3 is a flow chart illustrating execution of an embodiment of the computer program product of the present invention.

FIG. 3 is a logic flow diagram illustrating the code of one embodiment of a computer product program that may be used to implement embodiments of the method, such as the embodiment illustrated in FIG. 2. In step 32, a sheet of paper having a used face and an available face is received into a printer having an integral optical scanner. In step 34, a first face of the sheet is scanned using the scanner. In step 36, a signal is generated by the optical scanner to indicate whether the scanned face bears print thereon. If the scanned face bears print thereon then, in step 38, a signal generated in the optical scanner is sent to processor to indicate the presence of print on the scanned face of the sheet, in step 40, the processor activates a print head to print an obstruction on the scanned face of the sheet, and in step 42, the processor activates a print head to print new matter such as, for example, header data, on a face of the sheet opposite the scanned face of the sheet.

If the scanned face does not bear print thereon then, in step 37, a signal generated in the optical scanner is sent to the processor to indicate the absence of print on the scanned face of the sheet, in step 39, the processor activates a print head to print a header on the scanned face of the sheet and, in step 41, the processor activates a print head to print an obstruction on the face of the sheet opposite the scanned face of the sheet. Both branches of the embodiment of the computer product program illustrated in the logic flow diagram terminate at step 50 in which the sheet is moved to a pick-up tray.

It should be recognized that the methods of the present invention are not dependent upon the paper in Paper Source B actually having any used face, or that every sheet in Paper Source B have a used face. Rather, the methods of the invention enable used sheets of paper to be used, when available. If both faces of the sheet are unused, then the method continues by printing new matter on one face of the sheet, without the need to print an obstruction on the opposite clean face.

It should also be recognized that a user interface to the printer may allow a user to select whether or not to enable the methods of the present invention as to any one or more of the paper sources. If no used paper is to be supplied, then the methods may be disabled. The user interface may further enable a user to select whether or not both sides of the sheet need to be scanned. This selection may be beneficial where the user knows that only once-used sheets are being put into a given paper source. Still further, the user interface may allow the user to indicate whether or not the methods should be applied only to header sheets or to the entire print job. Thus, it is possible to specify that sheets be drawn from a paper source containing used sheets for printing headers, and new sheets be drawn from a separate paper source containing new sheets for printing the actual print job. As a result of the user making the appropriate selections of features via the user interface, the printer may operate at a more optimal speed, since each additional scan and each additional print task require additional time and energy.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon. For example, the user interface and the logic for implementing the methods of the invention may be implemented as software, firmware or hardware residing in the printer, or as a software print driver installed on a local computer or print server.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electro-magnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing.

Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described herein with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The flowchart and block diagrams in the figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The embodiments of the method of the present invention may be implemented, and the computer program product may be executable, using for example, but not by way of limitation, a Canon® Image Runner 3300i and a number of other models of copier/scanners available from Canon®, Sharp®, Kyocera®, Ricoh®, Toshiba®, Konica Minolta®, Hewlett-Packard®, Xerox® and others that produce and sell copiers having scanning capability.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, components and/or groups, but do not preclude the presence or addition of one or more other features, integers, steps, operations, elements, components, and/or groups thereof. The terms "preferably," "preferred," "prefer," "optionally," "may," and similar terms are used to indicate that an item, condition or step being referred to is an optional (not required) feature of the invention.

The corresponding structures, materials, acts, and equivalents of all means or steps plus function elements in the claims below are intended to include any structure, material, or act for performing the function in combination with other claimed elements as specifically claimed. The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A method of printing, comprising:

a printer receiving a print job including a document and header data relating to the document;

drawing a first sheet of used paper from a used paper source into a printer having an optical scanner and a print head;

using the optical scanner to scan a first face of the first sheet to detect the presence or absence of print thereon;

in response to detecting print on the first face of the first sheet, causing the print head to print an obstruction on the first face of the first sheet and print the header data on a second face of the first sheet without scanning the second face of the first sheet;

in response to detecting no print on the first face of the first sheet, causing the print head to print the header data of the print job on the first face of the first sheet;

drawing a second sheet of paper from an unused paper source into the printer; and printing at least a portion of the document of the print job on the second sheet of unused paper without scanning either face of the second sheet.

2. The method of claim 1, wherein no print is detected on the first face of the first sheet, the method further comprising:

scanning a second face of the first sheet to determine the presence or absence of print; and in response to detecting print on the second face of the first sheet, causing the print head to print an obstruction on the second face of the first sheet.

3. A method of printing, comprising:

a printer receiving a print job including a document and header data relating to the document;

drawing a first sheet of used paper from a used paper source into a printer having an optical scanner and a print head;

using the optical scanner to scan a first face of the first sheet to detect the presence or absence of print thereon;

in response to detecting print on the first face of the first sheet, causing the print head to print an obstruction on the first face of the first sheet and print the header data on a second face of the first sheet;

in response to detecting no print on the first face of the first sheet, causing the print head to print an obstruction on the second face of the first sheet without scanning the second face of the first sheet and print the header data of the print job on the first face of the first sheet;

drawing a second sheet of paper from an unused paper source into the printer; and printing at least a portion of the document of the print job on the second sheet of unused paper without scanning either face of the second sheet.

4. The method of claim 3, wherein the scanner is not used to scan the second face of the first sheet.

5. A computer program product including computer usable program code embodied on a non-transitory computer usable storage medium for controlling a printer, the computer program product comprising:

computer usable program code for receiving a print job including a document and header data relating to the document;

computer usable program code for causing a first sheet of used paper to be withdrawn from a used paper source into a printer having an optical scanner and a print head;

computer usable program code for scanning a first face of the first sheet to determine the presence or absence of print thereon;

computer usable program code for printing an obstruction on the first face of the first sheet and printing the header data on a second face of the first sheet in response to detecting print on the first face of the first sheet;

computer usable program code for printing the header data of the print job on the first face of the first sheet without scanning the second face of the first sheet in response to detecting no print on the first face of the first sheet;

computer usable program code for causing a second sheet of unused paper to be withdrawn from an unused paper source into the printer; and computer usable program code for printing at least a portion of the document of the print job on the second sheet of unused paper without scanning either face of the second sheet.

6. The computer program product of claim 5, wherein no print is detected on the first face of the first sheet, further comprising:

computer usable program code for causing the print head to print an obstruction on the second face of the first sheet without scanning the second face of the first sheet.

7. The computer program product of claim 6, wherein the scanner is not used to scan the second face of the first sheet.

* * * * *